US008243975B2

(12) United States Patent
Akino et al.

(10) Patent No.: US 8,243,975 B2
(45) Date of Patent: Aug. 14, 2012

(54) CONDENSER MICROPHONE UNIT

(75) Inventors: Hiroshi Akino, Machida (JP); Shioto Okita, Machida (JP); Noriko Matsui, Machida (JP); Satoshi Yoshino, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 280 days.

(21) Appl. No.: 12/656,250

(22) Filed: Jan. 22, 2010

(65) Prior Publication Data

US 2010/0189301 A1 Jul. 29, 2010

(30) Foreign Application Priority Data

Jan. 29, 2009 (JP) ..... 2009-017843

(51) Int. Cl.
*H04R 25/00* (2006.01)

(52) U.S. Cl. ..... 381/369; 381/174

(58) Field of Classification Search ..... 381/189, 381/355, 356, 357, 358, 359, 361, 369, 170–181
See application file for complete search history.

(56) References Cited

U.S. PATENT DOCUMENTS

| | | | | |
|---|---|---|---|---|
| 4,456,796 | A * | 6/1984 | Nakagawa et al. | 381/191 |
| 5,828,012 | A * | 10/1998 | Repolle et al. | 181/175 |
| 6,932,187 | B2 * | 8/2005 | Banter et al. | 181/149 |
| 2009/0257613 | A1 * | 10/2009 | Khamashta et al. | 381/355 |

* cited by examiner

*Primary Examiner* — Davetta W Goins
*Assistant Examiner* — Phylesha Dabney
(74) *Attorney, Agent, or Firm* — Manabu Kanesaka

(57) ABSTRACT

There is provided a condenser microphone unit in which the shield of a shielding member that covers a front acoustic terminal from the inside of a unit case is assured to prevent noise caused by electromagnetic waves radiated especially from a cellular phone from being generated. In a condenser microphone unit including a metallic cylindrical unit case 10 having a front acoustic terminal 11 on one end side; an electrostatic acousto-electric converter 20 housed in the unit case 10; and a shielding member 30 disposed between the acousto-electric converter 20 and the front acoustic terminal 11 to cover the front acoustic terminal 11 from the inside of the unit case 10, as the shielding member 30, there is used a shielding plate 32 consisting of a metallic porous plate integrally having a plurality of locking pieces 33, which dig into the inner wall surface of the unit case 10 on account of elastic deformation, in the peripheral edge part thereof.

7 Claims, 2 Drawing Sheets

CONDENSER MICROPHONE UNIT

CROSS-REFERENCE TO RELATED APPLICATION

The present application is based on, and claims priority from, Japanese Application Serial Number JP2009-017843, filed Jan. 29, 2009, the disclosure of which is hereby incorporated by reference herein in its entirety.

TECHNICAL FIELD

The present invention relates to a condenser microphone unit. More particularly, it relates to an electromagnetic wave shielding member provided on a front acoustic terminal.

BACKGROUND ART

As shown in FIGS. 3 and 4, a condenser microphone unit includes, as a general configuration, a unit case 10 and an electrostatic acousto-electric converter 20 housed in the unit case 10.

The unit case 10 is made of a metallic material such as aluminum or a brass alloy, and is formed in a cylindrical shape. On one end side of the unit case 10 directed to the sound source side at the time of sound pickup, a front acoustic terminal 11 is formed, and on the other end side thereof, an opening 12 for housing the acousto-electric converter 20 and the like is formed.

In this example, as shown in FIG. 3, the front acoustic terminal 11 is configured so that long first slit holes 11*a* and short second slitholes 11*b*, which are cut from the periphery on one end side of the unit case 10 toward the center thereof, are formed alternately. Aside from this configuration, in some cases, the front acoustic terminal 11 consists of one circular opening formed coaxially with the unit case 10.

The acousto-electric converter 20 includes a kind of condenser element configured so that a diaphragm 21 stretchedly provided on a support ring (diaphragm ring) 22 and a backplate 23 supported by an insulating seat 24 are disposed opposedly via an insulating spacer 25.

Since the condenser microphone unit of this conventional example is unidirectional, the backplate 23 consists of a porous plate. In the insulating seat 24, a sound hole 24*a* serving as a rear acoustic terminal is provided so that sound waves from the rear acoustic terminal 24*a* act on the back surface side of the diaphragm 21.

From the insulating seat 24, an electrode terminal rod 41 connected electrically to the backplate 23 by a conducting means (not shown) such as a lead wire is pulled out. The electrode terminal rod 41 is connected electrically to a gate electrode of a field effect transistor (FET) serving as an impedance converter (not shown) disposed in the opening 12 of the unit case 10.

In the unit case 10, a shielding member 30 that covers the front acoustic terminal 11 from the inner surface side is provided to prevent foreign matters and extraneous electromagnetic waves from intruding through the front acoustic terminal 11 (refer to Japanese Patent Application Publication No. 2004-343368).

Usually, as the shielding member 30, a metal mesh (a metallic mesh body) 31 is used. As the metal mesh 31 of this type, a stainless steel mesh (for example, wire diameter: 0.1 mm, #100 mesh, material: SUS304) has been used.

The metal mesh 31 is disposed on the inner surface side of the front acoustic terminal 11 and fixed thereto with an adhesive. To prevent the appearance from being impaired by the squeeze-out of adhesive, the metal mesh 31 is fixed to the inner surface of a front wall present in a central part of the front acoustic terminal 11 on one end side of the unit case 10.

The condenser microphone unit is assembled as described below. After the metal mesh 31 has been fixed as described above, the acousto-electric converter 20 is housed in the unit case 10, and a lock ring 27 having external threads is threadedly engaged with internal threads 13 formed in the inner wall of the unit case 10 and is tightened.

In the case where the unit case 10 is made of, for example, an aluminum material that is plastically deformed easily, the acousto-electric converter 20 is sometimes fixed by crimping the opening end edge in the rear part of the unit case 10 to the inside.

The shield due to the metal mesh 31 is effective against electric waves of VHF and UHF band used for broadcasting and the like. However, when a cellular phone, which has come into wide use rapidly in recent years, is used near a microphone, noise may be generated by the electromagnetic waves radiated from the cellular phone.

Specifically, the electromagnetic waves radiated from a cellular phone have high frequencies and short wave lengths, and in the range of several centimeters to several ten centimeters, the field intensity reaches several ten thousand times the field intensity produced in the city by commercial electric waves. Therefore, the electromagnetic waves radiated from a cellular phone reaches the backplate 23 through the openings in the metal mesh 31, whereby noise is generated.

One cause for this is that the metal mesh 31 is fixed to the unit case 10 exclusively with an adhesive, so that the electrical connection with the unit case is unreliable. Another cause for this is that the metal mesh 31 is plain-woven, and the electrical connection is made by intersections of longitudinal wires and transverse wires, so that the shield performance of the mesh itself is nonuniform.

Accordingly, an object of the present invention is to provide a condenser microphone unit in which the shield of a shielding member that covers a front acoustic terminal from the inside of a unit case is assured to prevent noise caused by electromagnetic waves radiated especially from a cellular phone from being generated.

SUMMARY OF THE INVENTION

To achieve the above object, the present invention provides a condenser microphone unit including a metallic cylindrical unit case having a front acoustic terminal on one end side; an electrostatic acousto-electric converter housed in the unit case; and a shielding member disposed between the acousto-electric converter and the front acoustic terminal to cover the front acoustic terminal from the inside of the unit case, wherein as the shielding member, there is used a shielding plate consisting of a metallic porous plate integrally having a plurality of locking pieces, which dig into the inner wall surface of the unit case on account of elastic deformation, in the peripheral edge part thereof.

According to a preferred mode of the present invention, the locking pieces each having a triangular shape are connectingly provided in an integral form in the peripheral edge part of the shielding plate at equal intervals, and are bent at a predetermined angle from the peripheral edge part of the shielding plate toward the side opposite to the front acoustic terminal so as to be able to be brought into contact under pressure with the inner wall surface of the unit case when the shielding plate is inserted into the unit case.

In the present invention, the front acoustic terminal may consist of a plurality of slit holes or may consist of one circular opening formed coaxially with the unit case.

According to the present invention, as the shielding member that covers the front acoustic terminal from the inside of the unit case, there is used the shielding plate consisting of the metallic porous plate integrally having the plurality of locking pieces, which dig into the inner wall surface of the unit case on account of elastic deformation, in the peripheral edge part thereof. Thereby, the shielding plate is reliably connected to the unit case electrically and mechanically. Also, since the shielding plate is a metallic porous plate, and the shield performance is uniform throughout the entire surface, a high-frequency electric current caused by extraneous electromagnetic waves does not intrude into the unit case, and flows to the unit case side. Therefore, noise caused by extraneous electromagnetic waves can be prevented from being generated.

Also, the locking pieces each having a triangular shape are connectingly provided in an integral form in the peripheral edge part of the shielding plate at equal intervals, and are bent at the predetermined angle from the peripheral edge part of the shielding plate toward the side opposite to the front acoustic terminal so as to be able to be brought into contact under pressure with the inner wall surface of the unit case when the shielding plate is inserted into the unit case. Thereby, the shielding plate can easily be fixed in the unit case merely by pushing the shielding plate into the unit case.

DETAILED DESCRIPTION

Figure 1:
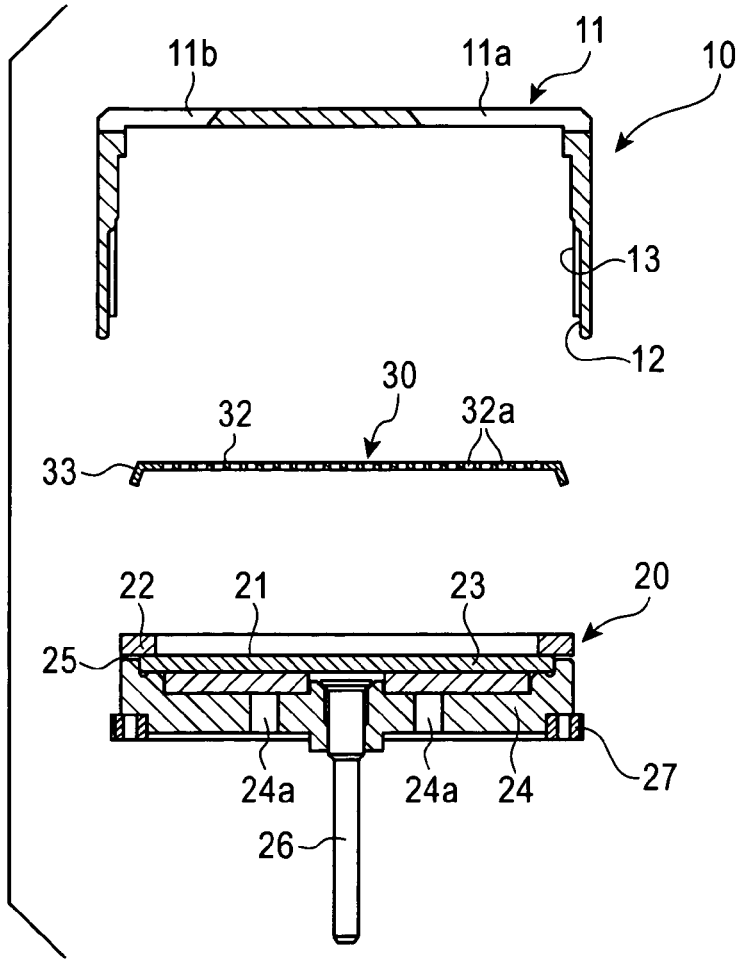
FIG. 1 is an exploded sectional view of a condenser microphone unit in accordance with the present invention.

An embodiment of the present invention will now be described with reference to FIGS. 1 and 2. The present invention is not limited to this embodiment. In the description of this embodiment, the same reference numerals are applied to elements that are the same as the elements in the conventional example shown in FIGS. 3 and 4.

Figure 2:
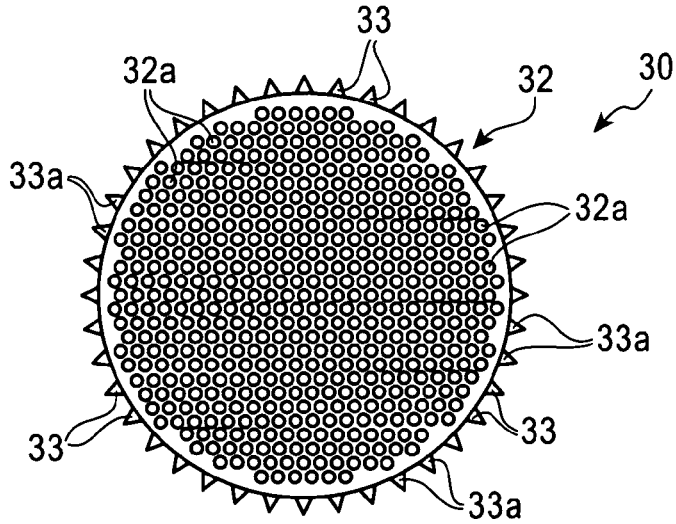
FIG. 2 is a plan view of a shielding member used in the present invention.

As shown in FIG. 1, the condenser microphone unit in accordance with this embodiment also includes, as a basic configuration, a unit case 10 and an electrostatic acousto-electric converter 20 housed in the unit case 10.

The unit case 10 is made of a metallic material such as aluminum or a brass alloy, and is formed in a cylindrical shape. On one end side of the unit case 10 directed to the sound source side at the time of sound pickup, a front acoustic terminal 11 is formed, and on the other end side thereof, an opening 12 for housing the acousto-electric converter 20 and the like is formed. In this embodiment, on the inner wall of the unit case 10, internal threads 13 with which a lock ring 27, described later, is engaged are formed.

Figure 3:
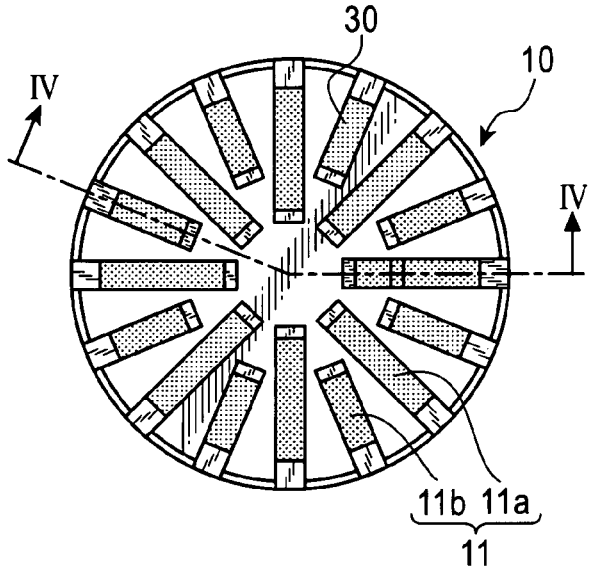
FIG. 3 RELATED ART
FIG. 3 is a plan view of a conventional condenser microphone unit, viewed from the front acoustic terminal side.
Figure 4:
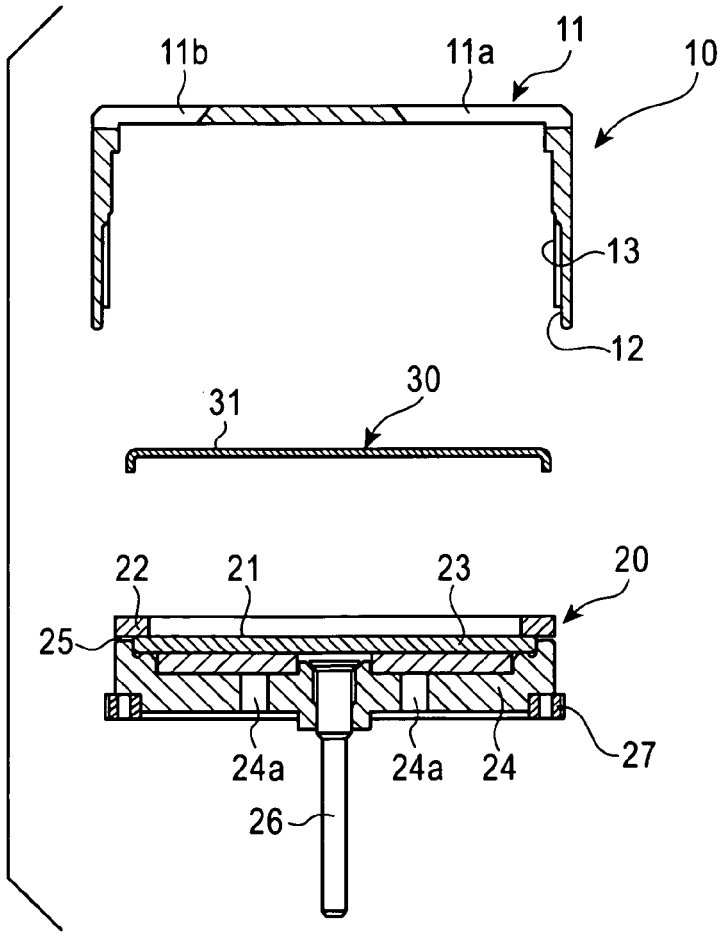
FIG. 4 RELATED ART
FIG. 4 is an exploded sectional view taken along the line A-A of FIG. 3.

Referring additionally to FIG. 3, the front acoustic terminal 11 is configured so that long first slit holes 11*a* and short second slit holes 11*b*, which are cut from the periphery on one end side of the unit case 10 toward the center thereof, are formed alternately. Aside from this configuration, the front acoustic terminal 11 may consist of one circular opening formed coaxially with the unit case 10.

The acousto-electric converter 20 includes a kind of condenser element configured so that a diaphragm 21 stretchedly provided on a support ring (diaphragm ring) 22 and a backplate 23 supported by an insulating seat 24 are disposed opposedly via an insulating spacer 25.

In the case where the condenser microphone unit is unidirectional, the backplate 23 is made a porous plate, and a sound hole 24*a* serving as a rear acoustic terminal is provided in the insulating seat 24 so that sound waves from the rear acoustic terminal 24*a* act on the back surface side of the diaphragm 21.

From the insulating seat 24, an electrode terminal rod 41 connected electrically to the backplate 23 by a conducting means (not shown) such as a lead wire is pulled out. The electrode terminal rod 41 is connected electrically to a gate electrode of a field effect transistor (FET) serving as an impedance converter (not shown) disposed in the opening 12 of the unit case 10.

In the present invention as well, in the unit case 10, a shielding member 30 that covers the front acoustic terminal 11 from the inner surface side is provided to prevent foreign matters and extraneous electromagnetic waves from intruding through the front acoustic terminal 11. In the present invention, as the shielding member 30, a shielding plate 32 as shown in FIG. 2 is used.

The shielding plate 32 consists of an elastically deformable, metallic porous plate (punching metal) formed in a disc shape having an outside diameter slightly smaller than the inside diameter of the unit case 10.

The shielding plate 32 is formed with a large number of holes 32*a*. In order to shield electromagnetic waves radiated from a cellular phone, the holes 32*a* each should have a diameter of 0.3 mm, and should be arranged in a zigzag pattern at a pitch distance of 0.6 mm. Also, the material of the shielding plate 32 is preferably a stainless steel material (especially, SUS304).

In the peripheral edge part of the shielding plate 32, a plurality of locking pieces 33 for fixing the shielding plate 32 to the inner wall surface of the unit case 10 are connectingly provided in an integral form. Actually, the shielding plate 32 is stamped out from a mother punching metal by using a press or the like as a form including the plurality of locking pieces 33.

It is preferable that the locking pieces 33 each assume a triangular shape so as to easily dig into the inner wall surface of the unit case 10, and be arranged at equal intervals in the peripheral edge part of the shielding plate 32.

The outside diameter of the shielding plate 32 passing vertexes 33*a* of the locking pieces 33 is made larger than the inside diameter of the unit case 10. To facilitate the insertion of the shielding plate 32 into the unit case 10, the locking pieces 33 are preferably bent at a predetermined angle from the peripheral edge part of the shielding plate 32 toward the side opposite to the front acoustic terminal 11.

According to this configuration, when the shielding plate 32 is inserted into (pressed in) the unit case 10 from the opening 12 side of the unit case 10 toward the front acoustic terminal 11 side, the plurality of locking pieces 33 are elastically deformed, and dig into the inner wall surface of the unit case 10. Therefore, in the state in which the shielding plate 32 is held to the inner surface of the front acoustic terminal 11, the shielding plate 32 can reliably be connected to the unit case 10 electrically and mechanically.

Thereafter, the acousto-electric converter 20 is housed in the unit case 10, and the lock ring 27 having external threads is threadedly engaged with the internal threads 13 formed in the inner wall of the unit case 10 and is tightened. Thereby, the condenser microphone unit is assembled.

As described above, according to the condenser microphone unit in accordance with the present invention, as the shielding member 30 that covers the front acoustic terminal 11 from the inside of the unit case 10, there is used the shielding plate 32 consisting of the metallic porous plate integrally having the plurality of locking pieces 33, which dig into the inner wall surface of the unit case 10 on account of elastic deformation, in the peripheral edge part thereof. Thereby, the shielding plate 32 is reliably connected to the unit case 10 electrically and mechanically. Also, since the shielding plate 32 is a metallic porous plate, and the shield performance is uniform throughout the entire surface, a high-frequency electric current caused by extraneous electromagnetic waves does not intrude into the unit case, and flows to the unit case side. Therefore, noise caused by extraneous electromagnetic waves can be prevented from being generated.

Also, the locking pieces 33 each having a triangular shape are connectingly provided in an integral form in the peripheral edge part of the shielding plate 32 at equal intervals, and are bent at the predetermined angle from the peripheral edge part of the shielding plate 32 toward the side opposite to the front acoustic terminal 11 so as to be able to be brought into contact under pressure with the inner wall surface of the unit case 10 when the shielding plate 32 is inserted into the unit case. Thereby, the shielding plate 32 can easily be fixed in the unit case 10 merely by pushing the shielding plate 32 into the unit case 10.

In the case where the unit case 10 is made of, for example, an aluminum material that is plastically deformed easily, the acousto-electric converter 20 can be fixed by crimping the opening end edge in the rear part of the unit case 10 to the inside. Also, although not shown, a circuit board mounted with the field effect transistor serving as the impedance converter can be disposed in the opening at the rear end of the unit case 10.

The invention claimed is:

1. A condenser microphone unit, comprising:

a metallic cylindrical unit case having a front acoustic terminal on one end side;

an electrostatic acousto electric converter housed in the unit case; and a shielding member disposed between the acousto-electric converter and the front acoustic terminal to cover the front acoustic terminal from an inside of the unit case, wherein the shielding member includes a shielding plate formed of a metallic porous plate integrally having a plurality of locking pieces, which dig into an inner wall surface of the unit case by elastic deformation, at a peripheral edge part thereof, and the plurality of locking pieces are bent at a predetermined angle from the peripheral edge art of the shielding plate toward a side opposite to the front acoustic terminal so as to contact under pressure with the inner wall surface of the unit case when the shielding plate is inserted into the unit case.

2. The condenser microphone unit according to claim 1, wherein the locking pieces each having a triangular shape are connectingly provided in an integral form at the peripheral edge part of the shielding plate at equal intervals.

3. The condenser microphone unit according to claim 1, wherein an outer diameter of the shielding plate is smaller than an inner diameter of the unit case, and an outer diameter of the shielding member passing vertexes of the plurality of the locking pieces is larger than the inner diameter of the unit case.

4. The condenser microphone unit according to claim 3, wherein the metallic porous plate has a plurality of holes thereon, and the plurality of holes have a diameter of 0.3 mm at a pitch distance of 0.6 mm from each other.

5. The condenser microphone unit according to claim 1, wherein the locking pieces are oriented outwardly and rearwardly from the peripheral edge part of the shielding plate toward the side opposite to the front acoustic terminal.

6. The condenser microphone unit according to claim 5, wherein an outer diameter of the shielding plate is smaller than an inner diameter of the unit case, and an outer diameter of the shielding member passing vertexes of the plurality of the locking pieces is larger than the inner diameter of the unit case.

7. The condenser microphone unit according to claim 6, wherein the metallic porous plate has a plurality of holes thereon, and the plurality of holes have a diameter of 0.3 mm at a pitch distance of 0.6 mm from each other.

* * * * *